United States Patent [19]

Marchant

[11] Patent Number: 4,802,624

[45] Date of Patent: Feb. 7, 1989

[54] RAIL CLIP ASSEMBLY HAVING A PIVOTED WEDGE MEMBER

[75] Inventor: Ian M. Marchant, Ashstead, England

[73] Assignee: GH International Ltd., George Town,

[21] Appl. No.: 85,794

[22] Filed: Aug. 17, 1987

[30] Foreign Application Priority Data

Aug. 28, 1986 [GB] United Kingdom ..... 8620832

[51] Int. Cl.[4] ..... E01B 9/66

[52] U.S. Cl. ..... 238/317; 238/331; 238/341; 238/364; 403/409.1

[58] Field of Search ..... 238/317, 331, 361, 364, 238/332, 334, 335, 341, 315, 362, 351; 403/409.1, 408.1, 374

[56] References Cited

U.S. PATENT DOCUMENTS

| | | | |
|---|---|---|---|
| 1,044,178 | 11/1912 | Holland | 238/317 |
| 1,562,458 | 11/1925 | Lehman | 238/317 |
| 3,923,245 | 12/1975 | Marchant | 238/331 |
| 4,251,030 | 2/1981 | Marchant | 238/362 |

FOREIGN PATENT DOCUMENTS

| | | | |
|---|---|---|---|
| 1110846 | 8/1984 | U.S.S.R. | 238/361 |

*Primary Examiner*—Carlton R. Croyle

*Assistant Examiner*—Leonard P. Walnoha

*Attorney, Agent, or Firm*—McAulay, Fields, Fisher, Goldstein & Nissen

[57] ABSTRACT

The present application describes a rail clip assembly, particularly but not exclusively for securing a crane rail to a flanged girder. The rail clip assembly comprises a body member (1) which has a base portion (2) for connection a rail support surface (3) and a lip portion (4) which can, in use, overlie an edge of a rail (5). The body member has a first surface (6) which, in use, extends parallel to the rail and abuts a lateral face of the rail, a second surface (8) facing away from the first surface and an elongate slot (9) for receiving a connector for connecting the body member to the rail support surface. The slot (9) extends in a direction which is generally inclined with respect to the first surface (6). The assembly further comprises a pivoting member (13) which pivots about a point which is located on the body member, the pivoting member including an aperture (14) for registration with the slot (9) and for receiving the connector. The pivoting member (13) has a surface which contacts the said second surface (8) of the body member, said second surface (8) being at an angle to the plane of the rail surface, whereby lateral forces applied by the rail and transmitted to the body, to the pivoting member, to the said connector, and to the rail support.

10 Claims, 3 Drawing Sheets

RAIL CLIP ASSEMBLY HAVING A PIVOTED WEDGE MEMBER

The present invention relates to a rail clip assembly, particularly but not exclusively for securing a crane rail to a flanged girder.

According to the present invention there is provided a rail clip assembly comprising a body member which has a base portion for connection a rail support surface and a lip portion which can, in use, overlie an edge of a rail, the body member having a first surface which, in use, extends parallel to the rail and abuts a lateral face of the rail, a second surface facing away from the first surface and an elongate slot for receiving a connector for connecting the body member to the rail support surface, the slot extending in a direction which is generally inclined with respect to the said first surface, the assembly further comprising a pivoting member which pivots about a point which is located on the body member, the pivoting member including an aperture for registration with the slot and for receiving the connector, the pivoting member having a surface which contacts the said second surface of the body member, said second surface being at an angle to the plane of the rail surface, whereby lateral forces applied by the rail are transmitted to the body, to the pivoting member, to the said connector, and to the rail support.

Preferably, the slot is curved and the pivoting member hinges about a point located substantially at the centre of curvature of the slot, for example on a cylindrical lug. Alternatively, if the slot is straight, the pivoting member can itself have a slot in which a cylindrical lug can travel as the aperture of the pivoting member travels along the slot of the body member.

The pivot point is preferably located on the opposite side of the slot to the said first surface.

Advantageously, the body member is wedge-shaped and thickens towards to the first surface, the sloping upper surface of the body member producing the said second surface. Preferably, the pivoting member is complimentarily wedge-shaped, so that its lower surface and the upper surface of the body member are in intimate contact with one another and so that its upper surface and the lower surface of the body member remain substantially parallel, as the member is pivoted Most preferably, the second surface is of helical form generated by rotation of a generator line rotated about the axis of the pivot point.

Alternatively, the second surface may be substantially perpendicular to the rail support surface and, in use, be abutted by an edge of the pivoting member.

Embodiments of the invention are described in detail below, by example only, with reference to the accompanying drawings, wherein.

Figure 1:
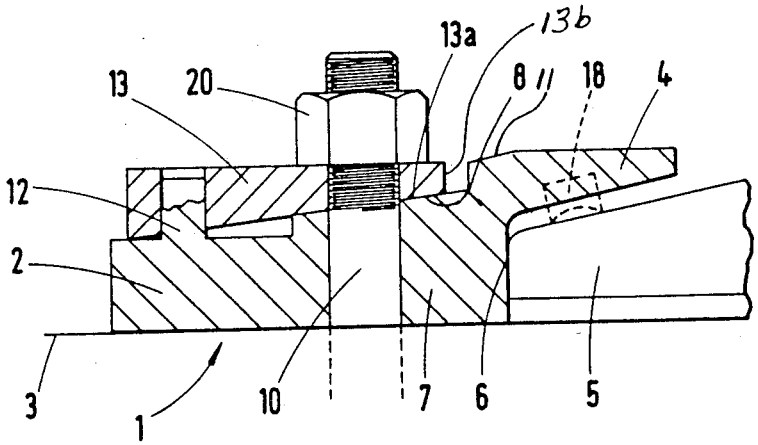
FIG. 1 is a sectional view of a rail clip assembly in accordance with the present invention.
Figure 2:
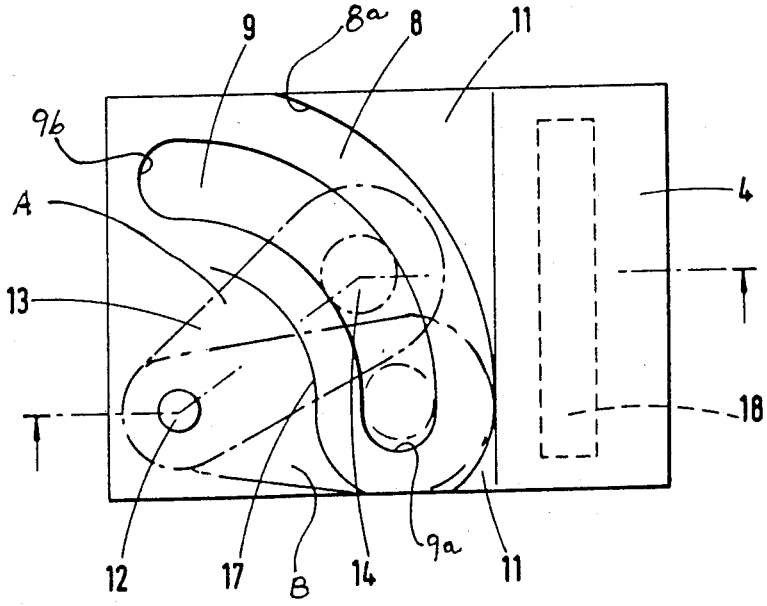
FIG. 2 is a plan view of the assembly of FIG. 1, without the pivoting member being shown.
Figure 3:
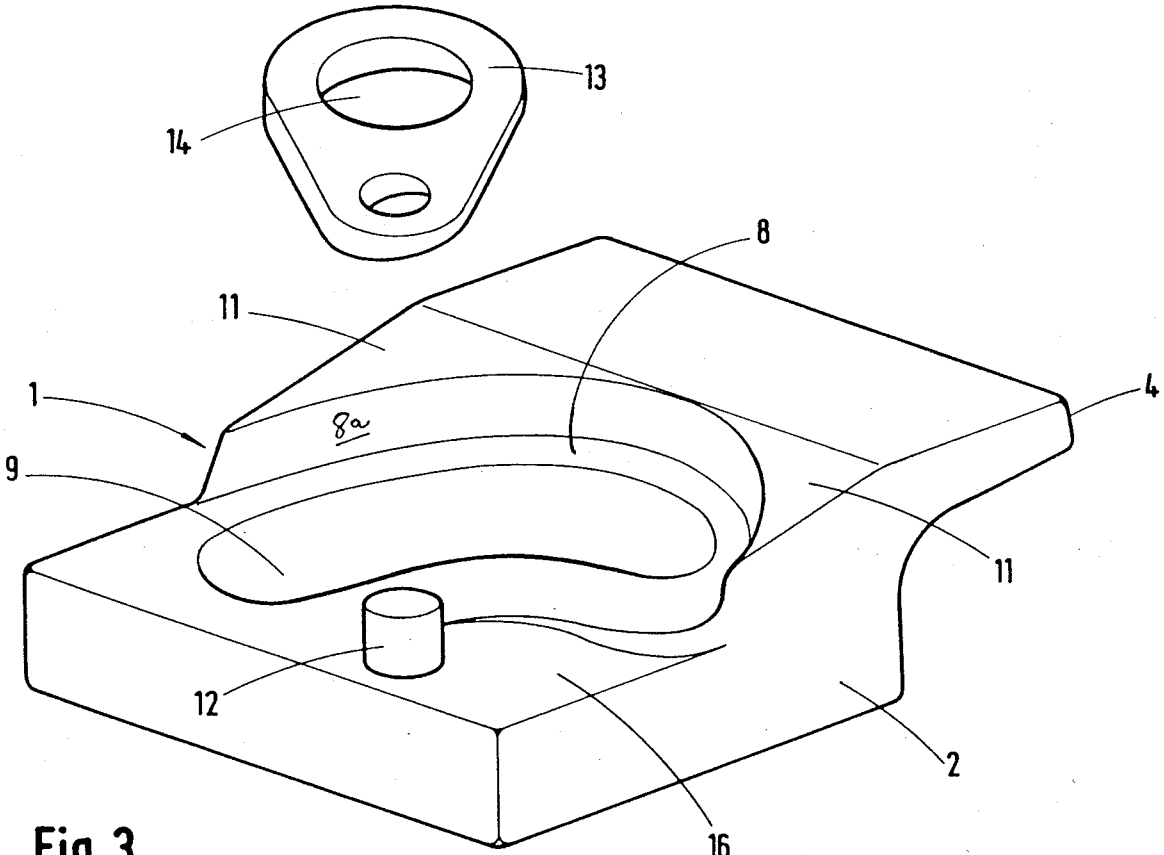
FIG. 3 is an orthogonal view of the clip of FIGS. 1 and 2.

The rail assembly of FIGS. 1, 2 and 3 comprises a body member 1 having a base 2 which can be connected to a flat rail support surface 3. The body 1 has a lip 4 which, in use, overlies a portion of a rail 5, for example a crane rail, which is supported on the rail support 3. Thus, the body 1 has, in cross-section, a generally Z-shaped configuration with the lip 4 over the rail 5 and the base 2 on the rail support 3. The body 1 has a first surface 6 which extends upwards from the lower surface 7 of the base 2 towards the lip 4. The first surface 6 is, in use, arranged parallel to and in contact with the edge of the rail 5 and extends in a plane substantially perpendicular to the plane of the rail support surface 3.

The base 2 has a second, upper surface 8, facing away from the first surface 6. The surface 8 extends at an inclined angle to the rail support surface 3, i.e. the base 2 is generally wedge-shaped, thickening towards the first surface 6. In the illustrated embodiment, the upper, second surface 8 of the base 2 is in fact of a helical form generated by the rotation of a generator line about an axis through the pivot 12, discussed below.

As most clearly seen in FIG. 2, the body 1 has an elongate slot 9 for receiving a connector 10 for connecting the body 1 to the rail support 3. The elongate slot allows for lateral adjustment of he lip relative to the connector 10, which may be a threaded stud welded to the rail support 3, and having a nut 20.

The slot 9 extends in a direction away from the first surface 6, a first right-hand end 9*a* being nearest to that surface and a second, left-hand end 9*b* being furthest away, so that any forces which in use tend to rotate the nut 20 will tighten it rather than slacken it.

In this embodiment, the slot 9 is curved with the outside of the curve facing the first surface 6. The edge of the above-mentioned second surface 8 follows the curve of the slot 9 and a step 8*a* is formed along this edge. The lip 4 connects to the top of the step 8*a* via inclined surfaces 11. At the centre of curvature of the slot 9 there is a cylindrical lug 12 on which is pivotally mounted a pivoting member 13. The member 13 includes an aperture 14 which registers with the slot 9 and through which the connector 10 fits. Member 13 further includes a lower surface 13*a* which rests on surface 8 of the body 1.

As mentioned above, the base 2 of the body 1 is substantially wedge-shaped and thickens towards the first surface 6. The member 13 is correspondingly wedge-shaped so that the upper surface 15 of the member 13 and the bottom surface 7 of the base 1 remain substantially parallel in all positions of the member 13 and so that the member 13 intimately contacts the body 1.

It should be noted, however, that all the upper surface of the base 2 need not be inclined. As shown in FIG. 3, there is a horizontal portion 16 adjacent the lug 12, this portion connecting to the upper, inclined surface via a step 17 which follows the curve of the slot 9.

In use, the body 1 and the pivoting member 13 are loosely assembled on the connector 10. The body is then moved relative to the stud and the rail, until it is located with its first surface 6 abutting the edge of the rail 5. During adjustment of the body 1, the pivoting member 13 automatically adjusts its position relative to the body.

The nut 20 is then threaded onto the stud and is tightened to fix the rail relative to the rail support 3.

Now, in use, any force applied laterally to the rail 5 will be transmitted via surfaces 8 and 13*a* to the pivoting member 13. In order words, the provision of the pivoting member 13 prevents the lateral forces from being applied directly to the stud. If the fractional forces between the abutting surfaces of the pivoting member 13 and body 1 and between the bottom surface of the body 1 and the rail support surface 3 are overcome, then the body 1 will move relative to the lug 12 and the pivoting member 13. Such movement results in increased tension in the stud 10 because the member 13 moves along the slot towards the first surface 6 and adopts a position where the wedge-shaped base is thicker. Thus, the above mentioned frictional forces are even greater and further lateral movement of the body is resisted.

In the embodiment described above, the inter-acting surfaces of the body 1 and the member 13 have been described as surfaces 8 and **13*a* and is shown by the dotted line position designated A in FIG. 2. However, if the surface of the step 8*a* of the body 1 and the edge 13*b* of the member 13 are designed to abut each other as indicated by the dotted line position designated B in FIG. 2, then these can also operate as the interactive surfaces. Thus, in this case, it is not essential that the body 1** has an inclined upper surface.

If the body 1 has an inclined upper surface **13*a* and if the edge 13*b* does abut the step 8*a*, then both of these pairs of surfaces are in fact acting to transfer forces from the body 1 to the member 12**.

It should also be noted that pivot point of the pivoting member 13 may, if desired, be located on the same side of the slot 9 as the first surface 6.

Figure 4:
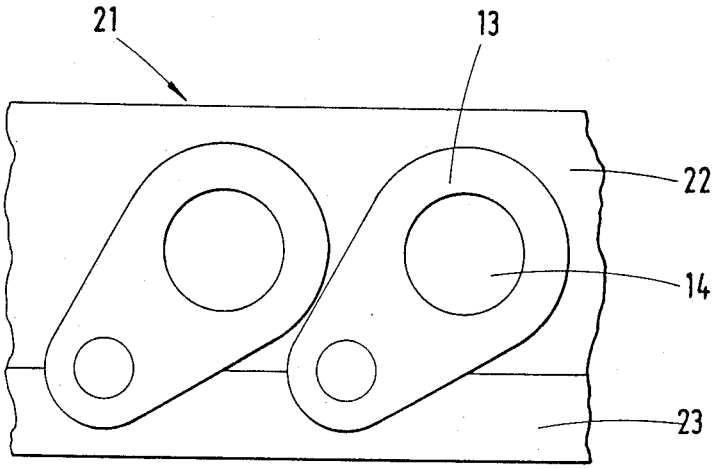
FIG. 4 shows a member of pivoting members being formed from a strip.

FIG. 4 shows a portion of a metal strip 21 from which the pivoting members 13 may be pressed. The strip 21 has, in cross-section, a flat base and an upper surface formed of an inclined, curved surface 22 and a flat surface 23 along one edge of the strip 21. The members 13 are pressed from the strip so that a line connecting their apertures 14 and pivots is at an angle ∠ of 45° to the longitudinal direction of the strip. Thus the member 13 thickens in a direction along that line and in a direction perpendicular to it.

Figure 5:
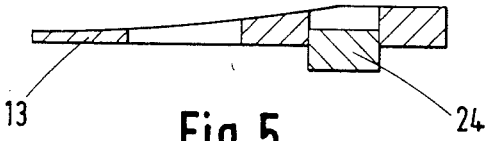
FIG. 5 is a sectional view of a pivoting member of FIG. 4.

FIG. 5 shows a section through a pivoting member 13 punched from a metal strip as shown in FIG. 4. It will be seen that a plug 24 is only partly punched from the strip so that the user is obliged to locate the member 13 on the lug 12 of the body member the right way up.

Figure 6:
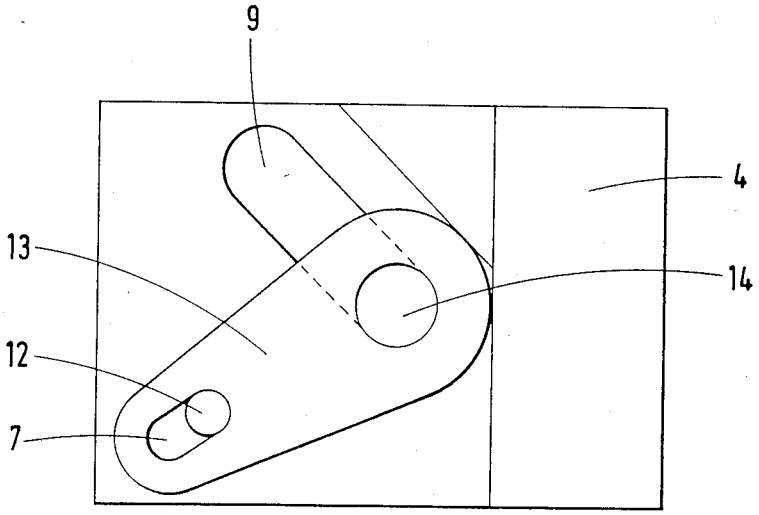
FIG. 6 is a plan view of another embodiment of the invention.

Turning now to the embodiment shown in FIG. 6 it will be seen that in this case the slot 9 is straight rather than curved. The pivoting member 13 pivots on a lug 12 located along a line substantially perpendicular to the direction of the slot and running from the end **9*a* of the slot. However, the lug 12** could alternatively be located in other positions, for example at the apex of a triangle having the slot as its base.

The pivoting member 13 itself has a slot 17 which, in the position illustrated, extends in a direction approximately perpendicular to that of the slot 9. Slot 17 is provided to accommodate the travel of the lug 12 as aperture 14 of the pivoting member 13 travels along the slot 9 in which the connector 10 is fitted.

In other respects, the assembly of FIG. 1 corresponds substantially to that of FIGS. 1 to 3.

In the above described embodiments, a pad 18 of elastomeric material may be provided in a recess along the underside of the lip 4. Such a resilient pad will, in use, bear on the upper side of the rail 5. Alternatively, the lip may be spaced from the rail so as to provide an upper limit to the possible movement of the rail.

The body member and pivoting member of the above embodiment may be made of cast steel, malleable cast iron or other similar material. The slot 9 may extend at an angle of approximately 30° to the surface 6 of the body, the direction of the slot being measured along a line connecting its two ends, to take into account the fact that the slot may be curved. The inclination of the upper surface of the body member may be 8°, for example, the lower surface of the pivoting member having a corresponding inclination relative to its upper surface.

I claim:

1. A rail clip assembly comprising a body member which has a base portion for connection to a rail support surface and a lip portion which can, in use, overlie an edge of a rail, the body member having a first surface which, in use, extends parallel to the rail and abuts a lateral face of the rail, a second surface facing away from the first surface and an elongate slot for receiving a connector for connecting the body member to the rail support surface, the slot extending in a direction which is generally inclined with respect to the direction of extent of the rail, the assembly further comprising a pivoting member which pivots about a point which is located on the body member, the pivoting member including an aperture for registration with the slot and for receiving the connector, the pivoting member having a surface which contacts the said second surface of the body member, said second surface being at an angle to the plane of the rail support surface, whereby lateral forces applied by the rail are transmitted to the body, to the pivoting member, to the said connector and to the rail support.

2. An assembly according to claim 1, wherein the slot is curved and the pivoting member hinges about a point located substantially at the center of curvature of the slot.

3. An assembly according to claim 1, wherein the slot is straight and the pivoting member has a slot in which a lug on the body member can travel as the aperture of the pivoting member travels along the slot of the body member.

4. An assembly according to claim 2, wherein the pivot point is located on the opposite side of the slot than the said first surface.

5. An assembly according to claim 1, wherein the body member is wedge-shaped and thickens towards to the first surface, and the sloping upper surface of the body member forming the said second surface.

6. An assembly according to claim 5, wherein the pivoting member is complementarily wedge-shaped, so that its lower surface and the upper surface of the body member are in intimate contact with one another and so that its upper surface and the lower surface of the body member remain substantially parallel as the member is pivoted.

7. An assembly according to claim 6, wherein the second surface is of helical form generated by rotation of a generator line about the axis of the pivot point.

8. An assembly according to claim 2, wherein the second surface is substantially perpendicular to the rail support surface and, in use, is abutted by an edge cf the pivoting member.

9. An assembly according to claim 3, wherein the second surface is substantially perpendicular to the rail support surface and, in use, is abutted by an edge of the pivoting member.

10. An assembly according to claim 3, wherein the pivot point is located on the opposite side of the slot than the said first surface.

* * * * *